United States Patent [19]

Helbling

[11] 4,067,454

[45] Jan. 10, 1978

[54] SUPPORT RAIL FOR TOBACCO STICKS

[76] Inventor: Francis A. Helbling, Route 2, Maysville, Ky. 40156

[21] Appl. No.: 613,809

[22] Filed: Sept. 16, 1975

[51] Int. Cl.[2] .....A24B 1/08; A47F 5/00

[52] U.S. Cl. ..... 214/5.5; 211/117; 211/123; 294/5.5

[58] Field of Search .....214/16.4 R, 214/16.4 A, 5.5; 211/113, 117, 123, 118; 34/33; 294/5.5

[56] References Cited

U.S. PATENT DOCUMENTS

| | | | |
|---|---|---|---|
| 322,330 | 7/1885 | Snow | 211/117 X |
| 593,186 | 11/1897 | Baker | 211/117 |
| 1,090,837 | 3/1914 | Clarke | 211/117 |
| 2,438,324 | 3/1948 | Pfeffer | 211/123 X |
| 2,867,918 | 1/1959 | Miller | 211/123 X |
| 3,580,386 | 5/1971 | Arnould et al. | 214/55 X |
| 3,610,426 | 10/1971 | Thomas | 211/117 |
| 4,032,165 | 6/1977 | Russell | 211/123 |

FOREIGN PATENT DOCUMENTS

| | | | |
|---|---|---|---|
| 54,813 | 10/1911 | Austria | 211/113 |
| 140,584 | 4/1920 | United Kingdom | 211/113 |

*Primary Examiner*—Johnny D. Cherry
*Assistant Examiner*—Carl Rowold
*Attorney, Agent, or Firm*—Frank C. Leach, Jr.

[57] ABSTRACT

A support rail has openings extending therethrough throughout its length to receive tobacco sticks with tobacco stalks thereon with adjacent openings having the tobacco sticks supported from opposite sides to balance the support rail. The support rail is mounted on a carrier or sled to enable the support rail with the tobacco sticks to be pulled into a tobacco barn by a tractor, for example. The support rail is mounted in vertically spaced relation to a base of the carrier so that the tobacco carried by the support rail will not engage the ground or the base. The support rail has a hook at the end of each of two ropes extending from its upper side to enable cables connected to a winch, which is mounted in the barn, to be connected thereto to lift the support rail from the carrier when the winch is activated. When the carrier returns to the barn a second time with another of the support rails, knots in each of the two ropes, which also extend from the bottom of the support rail connected to the winch through the connected cables, are connected to the hooks on the upper side of the support rail on the carrier to enable the support rail on the carrier to be connected to the support rail in the barn so that the support rail on the carrier may be lifted therefrom when the winch is activated. This process is continued until each bent of the barn is filled with a plurality of support rails in vertically spaced relation to each other with the uppermost support rail in each bent connected to one of the winches.

10 Claims, 6 Drawing Figures

SUPPORT RAIL FOR TOBACCO STICKS

A large portion of the cost of producing a tobacco crop is involved in removing the tobacco from the field in which it is grown and housing it in a barn where it is stored and allowed to cure. After curing, it is necessary to remove the tobacco from its stored position.

Because the housing in a barn of tobacco on tobacco sticks requires a significant amount of labor and the cost of labor has been increasing rapidly, the cost of producing a tobacco crop also has been increasing significantly. Thus, the cost of producing the tobacco crop could be reduced if the required labor could be decreased.

It has previously been suggested in U.S. Pat. No. 3,497,253 to Gentry, Jr. to dispose the tobacco sticks, which have tobacco stalks thereon, on a rack and to transport this rack to a barn. Then, the rack with the tobacco sticks still supported thereon has been raised by a fork lift so that latches on opposite ends of the rack are supported on support rails within the barn and on which the tobacco sticks have previously been supported directly by manual labor.

The apparatus of the aforesaid Gentry, Jr. patent requires skillful manipulation by a fork lift operator to remove the rack from the support rails of the barn. This is because the latches overlie the support rails of the barn and must be raised and tilted to be removed therefrom.

Thus, while the apparatus of the aforesaid Gentry, Jr. patent enables the transport of the tobacco to its curing position within the barn without requiring manual labor to lift the tobacco from the rack on which it is transported to the barn to its curing position within the barn, it requires the use and expense of a fork lift and an experienced operator thereof. Thus, while the apparatus of the aforesaid Gentry, Jr. patent reduces the required amount of labor to house the tobacco, it adds other substantial expenses thereto.

The apparatus of the present invention avoids the difficulties of the apparatus of the aforesaid Gentry, Jr. patent while still obtaining the desired reduction in labor costs. With the present invention, it is not necessary to utilize any type of fork lift or an experienced operator for operating the fork lift to house the tobacco.

With the present invention, it is only necessary to mount lifting means such as winches, for example, in the barn and to remove the support rails from the barn on which the tobacco sticks have been supported for curing. This is a one-time expense.

The present invention contemplates transporting a support rail to the field, having the tobacco sticks, which have the cut tobacco stalks thereon, supported on the support rail, returning the support rail to the barn, and then lifting the support rail with the tobacco sticks to a desired position within the tobacco barn by a winch and connected cables. Thus, the present invention does not require any fork lift or specific maneuvering thereof as is required by the apparatus of the aforesaid Gentry, Jr. patent.

In U.S. Pat. No. 1,015,553 to Gates, tobacco sticks are disposed in vertically spaced relation to each other within a barn for curing the tobacco thereon through connecting wires. However, the structure of the aforesaid Gates patent does not significantly reduce the labor costs since there is no suggestion of any manner in which the tobacco sticks can be transported directly from the field to their support positions in the barn or to connect the tobacco sticks to each other without the use of additional labor. Additionally, the structure of the aforesaid Gates patent requires fixed beams or rails within the barn to support the tobacco sticks but does not explain how the tobacco sticks can pass therebetween as would be required by the uppermost row of tobacco sticks when the tobacco sticks are lifted. Furthermore, the aforesaid Gates patent requires a movable hoisting apparatus to be moved to a different position to raise each group of the connected tobacco sticks.

The present invention avoids the difficulties of the aforesaid Gates patent since a single support rail has many of the tobacco sticks mounted thereon. Additionally, there are no support rails in the bar to interfere with the lifting and lowering of the support rails having the tobacco sticks thereon. Thus, the difficulty of how to support the tobacco sticks, as exists in the aforesaid Gates patent, does not occur with the apparatus of the present invention.

When housing tobacco with the support rails in the barn spaced at fixed vertical distances from each other, some of the tobacco may be of a greater length than the distance therebetween so that there will be an overlapping of tobacco on two adjacent vertically spaced rails. This can cause house burn of the tobacco during curing.

The present invention satisfactorily solves this problem through enabling the tobacco to be vertically spaced in tiers or bents at any desired vertical distance between any two support rails. Thus, the tobacco can be supported within the barn by the apparatus of the present invention without having the tobacco in the adjacent vertical tiers or bents contact each other.

In some prior suggested tobacco housing arrangements for reducing labor, various types of new tobacco barns have been proposed. However, this has deterred the use of the new suggested means for use with the new type barn because of the substantial cost in erecting new barns and the economic loss of the use of the old barns.

The present invention satisfactorily overcomes this problem through being able to utilize presently available barns with only slight modifications. Thus, the cost for these modifications is relatively small in comparison with the economic saving in labor, and the old barn is still employed.

An object of this invention is to provide an apparatus for harvesting tobacco.

Another object of this invention is to provide an apparatus for obtaining any desired vertical spacing between various tiers of tobacco in a tobacco barn.

Other objects of this invention will be readily perceived from the following description, claims, and drawings.

This invention relates to an apparatus for harvesting tobacco including a support rail having a plurality of substantially parallel openings extending therethrough along its length with the openings being substantially equally spaced from each other. Each of the openings receives one end of a tobacco stick therein for support thereby with the ends of adjacent sticks disposed on alternate sides of the support rail. The support rail has connecting means extending from opposite sides thereof to enable the support rail to be connected in vertically spaced relation to lifting means within a barn or another of the support rails disposed thereabove and to enable the support rail to be connected in vertically spaced relation to another of the support rails therebeneath.

The attached drawings illustrate a preferred embodiment of this invention, in which.

Figure 1:
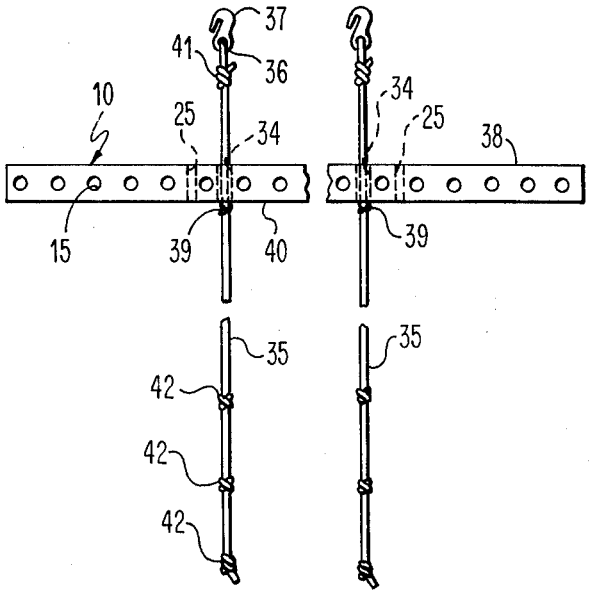
FIG. 1 is a side elevational view of a support rail of the present invention on which tobacco sticks can be mounted.

Referring to the drawings and particularly FIG. 1, there is shown a support rail 10, which could be a rail removed from a tobacco barn 11 (see FIGS. 3 and 4), for example. Of course, the support rail 10 can be any suitable rail capable of supporting a plurality of tobacco sticks 17 (see FIG. 2) thereon. Each of the tobacco sticks 12 has cut tobacco stalks 14 mounted thereon in the well-known manner.

Figure 2:
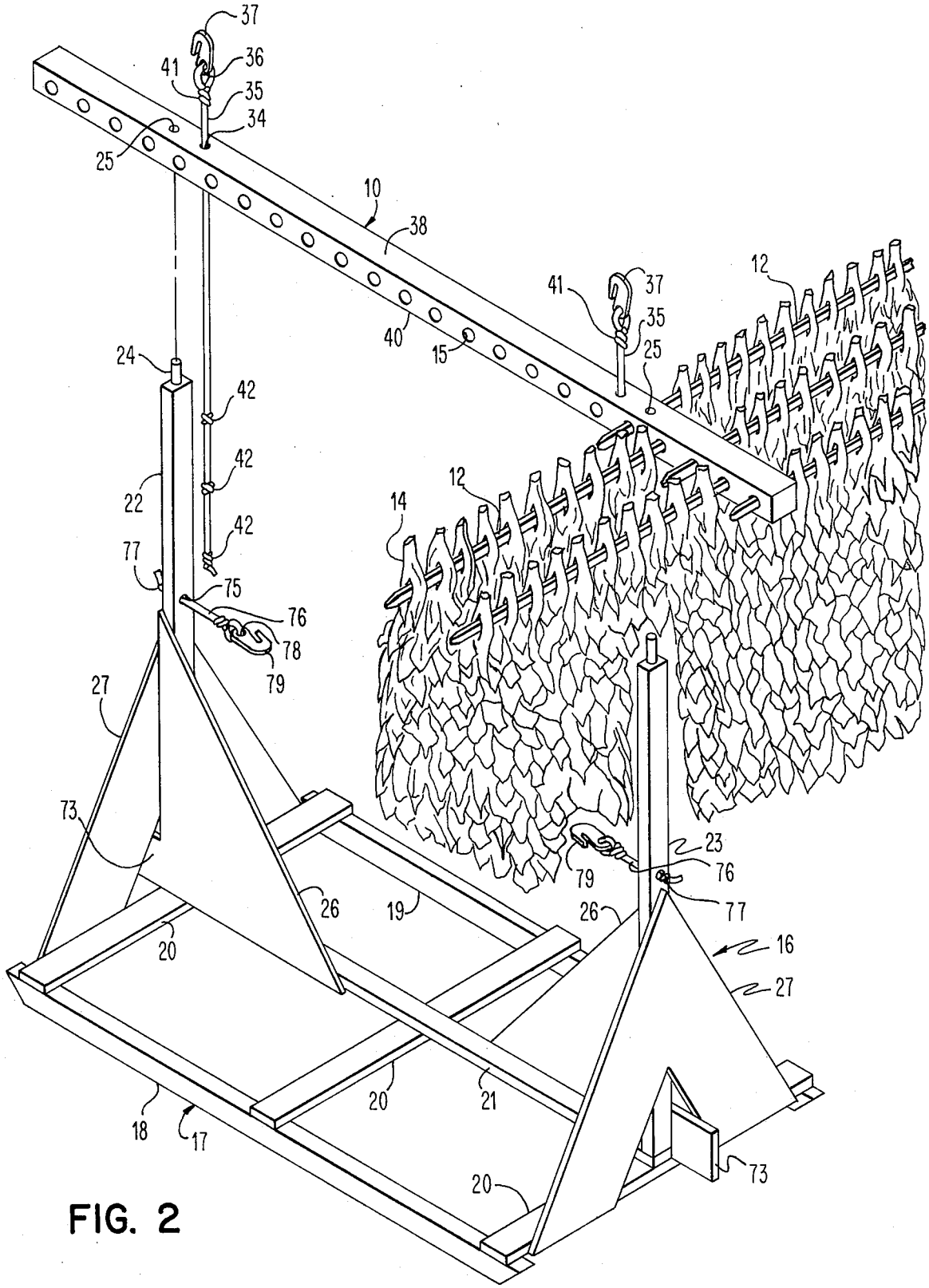
FIG. 2 is a perspective view of a carrier for supporting the support rail of FIG. 1 for transport between the field and the barn with the rail of FIG. 1 shown spaced from the carrier.

The support rail 10 has a plurality of substantially parallel openings or passages 15 (see FIGS. 1 and 2) extending therethrough with each of the passages 15 being substantially the same distance from each of the adjacent passages 15. As shown in FIG. 2, each of the passages 15 receives one end of one of the tobacco sticks 12 on which the tobacco stalks 14 have previously been mounted after being cut in the field with the tobacco sticks 12 being disposed in alternate sides of the support rail 10.

A carrier or sled 16 is employed to transport the support rail 10 between the barn 11 and the field and vice versa. The carrier 16 includes a base 17, which is formed of a pair of substantially parallel runners 18 and 19 joined to each other by cross members 20 extending therebetween and fixed to the top of each of the runners 18 and 19 by suitable securing means such as nails, for example.

The base 17 also has a support member 21 disposed substantially parallel to the runners 18 and 19 and fixed to the tops of the cross members 20. The support member 21 is located substantially the same distance from each of the runners 18 and 19.

The carrier 16 has a support post 22 extending upwardly from the support member 21 at one end of the carrier 16 and a support post 23 extending upwardly from the support member 21 at the other end of the carrier 16. The upper end of each of the support posts 22 and 23 has a pin 24 extending upwardly therefrom for disposition within an aligned passage or opening 25 in the support rail 10 and extending therethrough.

The passages or openings 25 are substantially perpendicular to the axes of the openings or passages 15. Thus, when the pins 24 are disposed in the passages or openings 25 in the support rail 10, the support rail 10 is supported on the carrier or sled 16 in vertically spaced relation to the base 17 so that the tobacco of the stalks 14 supported on the tobacco sticks 12 mounted on the support rail 10 do not contact the ground or the carrier 16.

Each of the support posts 22 and 23 is held in a vertical position by a triangular shaped brace 26, which is fixed to the support post 22 or 23 and the support member 21 of the base 17 of the carrier 16. A V-shaped brace 27 is secured to each of the support posts 22 and 23 and the cross member 20 above which the support post 22 or 23 is disposed on the support member 21.

With the support rail 10 supported on the support posts 22 and 23, the ends of the tobacco sticks 12, which have the tobacco stalks 14 thereon, can be easily inserted into the passages or openings 15 in the support rail 10 from their positions in the field in which the tobacco has been grown and cut. To balance the load of tobacco on the support rail 10, the tobacco sticks 12 in adjacent of the passages 15 are disposed on opposite sides of the support rail 10.

After the support rail 10 has been loaded with the tobacco sticks 12, the carrier 16 is pulled by any suitable means such as a tractor, for example, to the barn 11. It should be understood that more than one of the carriers 16 can be pulled by the tractor through the connection of the carriers 16 to each other.

A suitable flexible connecting element can be utilized to connect the adjacent carriers 16 to each other and one of the carriers 16 to the tractor. Thus, for example, each of the flexible connecting elements could be a chain with one end of the chain having a hook and the other end of the chain having a ring.

When connecting the tractor to the closest of the carriers 16, the ring could be connected to the clevis of the drawbar of the tractor and then the chain wrapped a couple of turns around the support member 21 adjacent the end of the nearest triangular shaped brace 26 to the tractor and then returned toward the tractor with the hook being connected to the chain when the chain is taut.

The connection between two of the adjacent carriers 16 with one of the carriers 16 being connected to the tractor contemplates wrapping the chain a couple of turns around the support member 21 of the carrier 16 connected to the tractor and adjacent the end of the triangular shaped brace 26 remote from the tractor and then passing the chain through the ring. The chain is then extended to the other of the carriers 16 and wrapped around the support member 21 adjacent the end of the triangular shaped brace 26 closest to the carrier 16 connected to the tractor. Then, the chain is extended towards the carrier 16 connected to the tractor until the chain is taut; the hook is then connected to the chain. This same arrangement can be used to connect any two of the adjacent carriers 16.

The support rail 10 has a pair of substantially parallel passages or openings 34 extending therethrough and disposed substantially parallel to the passages 25. The passages 34 are disposed between the passages 25.

A rope 35 extends through each of the passages 34. The upper end of the rope 35 is connected to an eyelet 36 of a hook 37. The hook 37 extends upwardly from the top side 38 of the support rail 10.

The rope 35 has a knot 39 (see FIG. 1) formed therein so that the hook 37 can extend upwardly for a predetermined distance above the top side 38 of the support rail 10 and to limit the upward movement of the rope 35 through the knot 39 engaging lower side 40 of the support rail 10. The rope 35 also has a knot 41 above the knot 39 to limit the downward movement of the rope 35 through the passage 34.

The rope 35 extends downwardly from the lower side 40 of the support rail 10. The lower end of the rope 35 has three knots 42 therein. The knots 42 are spaced 7 inches from each other with the uppermost of the three knots 42 being 34 inches from the knot 39.

When two of the support rails 10 are connected to each other by the ropes 35 and the hooks 37, one of the knots 42 of the rope 35 of the uppermost of the two support rails 10 is disposed in the hook 37 of the support rail 10 therebeneath to form a connection therebetween. The three knots 42 of the rope 35 enable the vertical spacing between the support rails 10 to be adjusted in accordance with the length of tobacco supported on the tobacco sticks 12 on the uppermost of the two support rails 10.

Figure 4:
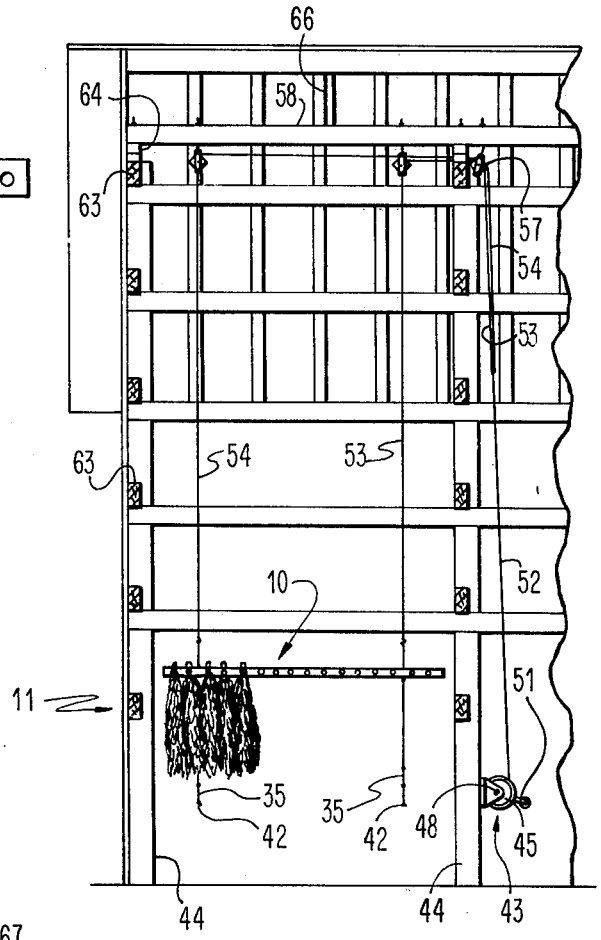
FIG. 4 is a schematic side elevational view of the barn of FIG. 3 and showing the barn having one support rail with tobacco mounted thereon.
Figure 6:
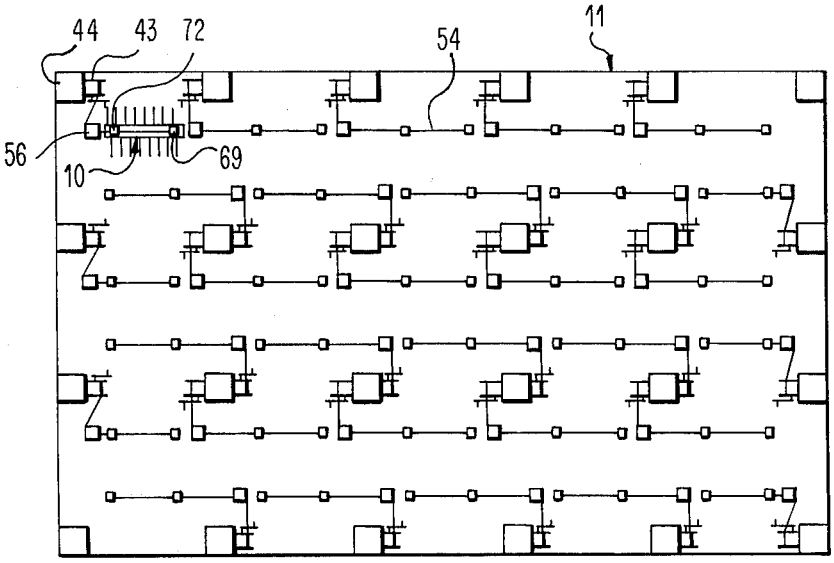
FIG. 6 is a schematic plan view showing the relationship of winches to support posts for various support rails.

When the first of the support rails 10 is transported by the carrier 16 from the field to the barn 11, the support rail 10 is positioned so that each of the hooks 37 on the top side 38 of the support rail 10 can be connected to lifting means within the barn 11. The lifting means includes a winch 43 (see FIGS. 3 and 4), which is mounted on one of support posts 44 of the barn 11. As shown in FIG. 4, the winch 43 is disposed on the side of the support post 44 remote from the bent in the barn 11 in which the support rail 10 is to be raised except for the bent closest to one end of the barn 11. In this bent, the winch 43 must be supported on the support post 44 within the bent in which the support rail 10 is being lifted as shown in FIG. 6.

The winch 43 can be any suitable type and can be manually operated or mechanically driven. One suitable example of the winch 43 is sold by Gold Foundry and Machinery Works, Independence, Missouri as model 813-89280. The winch 43 includes a drum 45 having gear teeth on its inner surface for meshing with a gear, which is mounted on a shaft 48. The shaft has a second gear mounted thereon. The second gear meshes with a gear, which is rotated by a handle 51.

Figure 5:
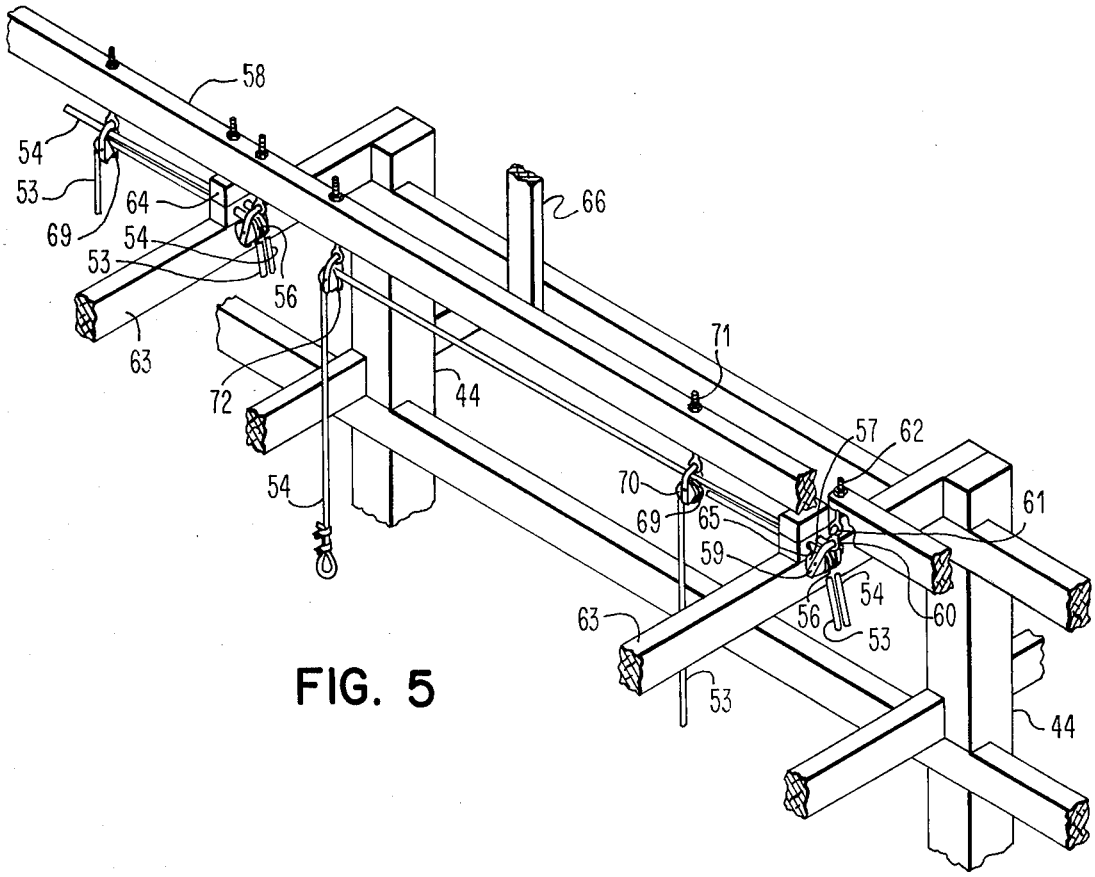
FIG. 5 is a perspective view of a portion of the support rail lifting arrangement in the barn.

A cable 52 is wound around the drum 45 of the winch 43 and extends upwardly therefrom. A pair of cables 53 and 54 is connected to the cable 52 by a clamp. The cables 53 and 54 pass around a double pulley 56 (see FIG. 5).

Figure 3:
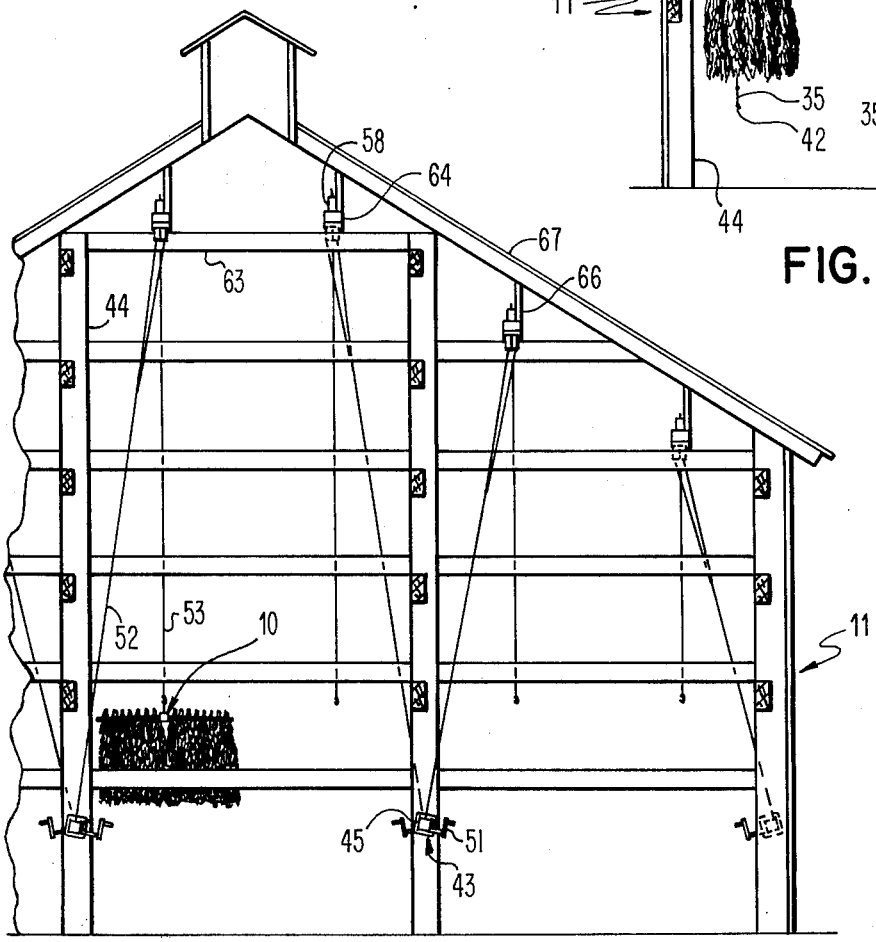
FIG. 3 is a schematic end elevational view of a tobacco barn in which the tobacco is supported therein by the support rails of the present invention.

As shown in FIG. 3, the drum 45 is at an angle to the horizontal so that the cable 52 is 90° to the axis of the drum 45. The angle of the cable 52 relative to the vertical is determined by the angle of the double pulley 56 from which the cables 53 and 54, which are connected to the cable 52 by the clamp, extend. The clamp, which connects the cables 53 and 54 to the cable 52, is so disposed that it will be approximately 6 inches from the double pulley 56 when the cables 53 and 54 are at their lowestmost positions to pick up the first of the support rails 10 from the carrier 16.

The double pulley 56 is carried in a block 57, which is secured to a roof beam 58. The block 57 has a strap 59 extending therearound and passing through an eyelet 60 of a hook 61. The hook 61 is secured to an eye bolt 62, which is connected to the roof beam 58.

The roof beam 58 is disposed in spaced relation to cross ties 63, which extend between the support posts 44 of different rows of the barn 11. The roof beams 58 are maintained in vertically spaced relation to the cross ties 63 by blocks 64. One of the blocks 64 has separate openings 65 therein to enable the cables 53 and 53 to pass therethrough after the cables 53 and 54 have passed around the double pulley 56.

The roof beam 58 and the blocks 64 are connected to each of the cross ties 63 by suitable connecting means such as bolts, for example. Between the adjacent cross ties 63, the roof beam 58 has a connecting beam 66 extending upwardly to a roof 67 of the barn 11.

The cable 53 passes over a pulley 69, which is supported in a block 70. The block 70 is connected by an eye bolt 71 to the roof beam 58 in the same manner as the block 57 is connected to the eye bolt 62. The cable 53 has a loop at its bottom end for connection to one of the hooks 37 on the support rail 10 to be connected thereto. The loop at the bottom end of the cable 53 is formed by securing the free end of the cable 53 to a portion of the cable 53 thereabove by a pair of clamps.

The cable 54 passes through the pulley 69 and around a pulley 72, which is secured to the roof beam 58 in the same manner as the pulley 69. The cable 54 has a loop at its lower end for connection to the other of the hooks 37 of the support rail 10. The cable 54 has the loop formed in the same manner as the loop is formed in the cable 53.

Accordingly, when the handle 51 of the winch 43 is rotated, the support rail 10 is lifted from the carrier 16. The amount of lifting of the support rail 10 is only enough to insure that the tobacco stalks 14 have their leaves positioned above the tops of the support posts 22 and 23 so that the carrier 16 can be removed from the barn 11 without contact with the leaves of the tobacco stalks 14.

If the floor of the barn 11 should be uneven, the pin 24 on one of the support posts 22 and 23 may bind within the receiving passage 25 in the support rail 10 to prevent removal therefrom. Accordingly, the carrier 16 has a projection or foot 73 (see FIG. 2) extending outwardly from each of the support posts 22 and 23 and integral with the brace 26. The projection 73 extending outwardly from the support post 22 or 23 having the pin 24 binding in the passage 25 in the support rail 10 is pushed downwardly to remove the pin 24 from the passage 25.

After removal of the support rail 10 from the carrier 16, the carrier 16 has another of the support rails 10 mounted on the support posts 22 and 23. The carrier 16 is then returned to the field along with any other of the carriers 16 connected thereto.

More of the tobacco sticks 12 in the field are positioned in the passages or openings 15 in the support rail 10 on the carrier 16 to load the support rail 10. When the support rail 10 has been filled with the tobacco sticks 12, it is returned by the carrier 16 to the barn 11 and postioned beneath the support rail 10, which has previously been raised by the winch 43.

The hooks 37 of the support rail 10 on the carrier 16 are connected to the ropes 35 of the support rail 10 disposed thereabove within the barn 11 and suspended from the ends of the cables 53 and 54. After this connection, the winch 43 is activated to raise the support rail 10 from the carrier 16 until the tobacco on the tobacco sticks 12 supported by the support rail 10 clears the top of the support posts 22 and 23 of the carrier 16.

This process is continued until the barn 11 is filled with tobacco. Thus, with the barn 11 having its roof 67 sloped as shown in FIG. 3, the portion of each of the bents closer to the row of the center support posts 44 holds more of the support rails 10 than the portion of the bent closer to one of the rows of the outer support posts 44.

When the carriers 16 bring the final loads of tobacco on the support rails 10 into the barn 11, the carriers 16 do not have to have the support rails 10 removed therefrom. Instead, the support rails 10 can remain on the carriers 16 to cure.

The number of the carriers 16 can vary as desired. Thus, the use of two tractors, for example, would be more efficient since one could be in the field with three of the carriers 16 to be loaded and the other in the barn 11 having the support rails 10 removed from the carriers 16. In this arrangement, a minimum of six of the carriers 16 would be utilized.

Whenever it is desired to remove the tobacco stalks 14 from the tobacco sticks 12 after the tobacco has cured, each of the winches 43 is activated to lower the lowermost of the support rails 10 connected thereto to a position in which the tobacco sticks 12 can be removed from the lowermost support rail 10 separately. Thus, no additional structure is needed to remove the tobacco sticks 12 from the support rail 10. Furthermore, the support rail 10 could be lowered the prior day to when the tobacco sticks 12 are to be removed from the support rail 10 for the tobacco to be stripped whereby the tobacco will come into case, which means that the tobacco has the desired moisture for stripping, by the next morning.

After the tobacco has been removed from all of the support rails 10, the support rails 10 can be supported in the barn 11 from the cables 53 and 54 and the connecting ropes 35. Furthermore, each of the carriers 16 can be suspended from the lowermost of the support rails 10 in one of the tiers or bents of the barn 11. Thus, no storage space is required on the floor of the barn 11.

To support each of the carriers 16 from the lowermost of the support rails 10 in one of the tiers or bents of the barn 11, it is necessary to provide each of the carriers 16 with connecting means. Accordingly, each of the support posts 22 and 23 has an opening 75 through which a rope 76, which is like the rope 35, for example, extends. One end of the rope 76 has a knot 77 formed therein while the other end of the rope is connected to the eyelet 78 of a hook 79. Each of the hooks 79 has the lowermost of the knots 42 of one of the ropes 35 on the lowermost of the support rails 10 disposed therein to connect the carrier 16 to the lowermost of the support rails 10.

When the winch 43 is supported on the support post 44 within the bent in which the support rail 10 is being lifted, it also is necessary for the double pulley 56 to be supported within the same bent. The double pulley 56 is disposed as close to the support post 44 as possible.

It should be understood that the cross ties 63, which extend between the support posts 44 in different rows in the barn 11, are retained within the barn 11. Thus, the support rails 10 must have a length to fit between two of the cross ties 63. Of course, there also are beams or supports extending between the various support posts 44 in any row in the barn 11 in the same direction as the support rails 10 are supported within the barn 11.

The present invention contemplates removing some of the support rails of the barn and cutting them so that they will be of a length less than the distance between the cross ties 63 of the barn 11, for example, to enable their use as the support rails 10. Of course, the support rails 10 could be formed from any suitable material having the desired length, which is less than the distance between the cross ties 63. However, it is still necessary to remove the rails extending between the cross ties 63 of the barn 11, for example, to accommodate the support rails 10.

While the present invention has shown and described the support rails 10 having the ropes 35 to form the connecting means therebetween, it should be understood that any suitable means, preferably flexible, could be employed. For example, a chain, which is flexible, could be utilized.

An advantage of this invention is that the labor required for housing tobacco is substantially reduced. Another advantage of this invention is that a new barn is not required. A further advantage of this invention is that it may be used with present barns with only slight modifications of the barn. Still another advantage of this invention is that any desired vertical spacing between tiers of tobacco can be obtained.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

I claim:

1. An apparatus for harvesting tobacco including:

a support rail;

said support rail having a plurality of substantially parallel openings extending therethrough along its length, said openings being substantially equally spaced from each other;

each of said openings receiving therein one end of a tobacco stick with tobacco thereon for support by said support rail with the ends of adjacent sticks disposed on alternate sides of said support rail;

and said support rail having a pair of connecting means connected thereto, each of said connecting means including first and second means extending from opposite sides of said support rail in a direction substantially perpendicular to said openings, said first means extending from one of the opposite sides of said support rail and connecting to lifting means within a barn to maintain said support rail in vertically spaced relation thereto when said support rail is the uppermost support rail and connecting to the second means of the connecting means of a support rail disposed above said support rail to maintain said support rail in a vertically spaced relation to the support rail disposed thereabove when said support rail is not the uppermost support rail, and second means extending from the other of the opposite sides of said support rail and connecting to the first means of the connecting means of a support rail disposed beneath said support rail to maintain said support rail in vertically spaced relation to the support rail therebeneath, wherein each of said connecting means of each of said support rails has its first means aligned vertically with the second means of the connecting means on the support rail disposed above said support rail and has its second means aligned vertically with the first means of the connecting means on the support rail disposed beneath said support rail when the support rails are vertically disposed.

2. The apparatus according to claim 1 including passage means within said support rail and extending between the opposite sides of said support rail and substantially perpendicular to the axes of said openings to receive support means for said support rail.

3. In combination with the apparatus according to claim 2, a carrier, said carrier having a base, means extending upwardly from said base for disposition within said passage means of said support rail to support said support rail in spaced relation to said based to preclude the tobacco on the tobacco sticks from touching said base when said support rail is supported on said carrier, and means secured to said base to support said carrier for movement along the ground in a direction substantially parallel to said support rail.

4. The combination according to claim 3 in which said upwardly extending means of said carrier includes:

a pair of support posts;

and means on the upper end of each of said support posts for disposition within said passage means of said support rail.

5. The combination according to claim 4 in which each of said second means of each of said connecting means of said support rail includes a plurality of means for selective connection to said first means of a corresponding one of said connecting means on another of said support rails disposed therebeneath to vary the vertical spacing between said support rail and another of said support rails disposed therebeneath.

6. The combination according to claim 4 in which said pair of connecting means of said support rail includes:

a pair of passages extending between the opposite sides of said support rail and substantially perpendicular to the axes of said openings;

a flexible member extending through each of said passages;

said first means of each of said connecting means including attachment means connected to the upper end of each of said flexible members;

each of said flexible members having means on the opposite sides of said support rail to limit the movement in either direction of said flexible member within said passage;

and said second means of each of said connecting means including means on each of said flexible members for connection to said attachment means of another of said support rails therebeneath to permit the vertical spacing between the support rails to be varied.

7. The combination to claim 6 in which said attachment means connected to the upper end of each of said flexible members is a hook.

8. The apparatus according to claim 1 in which said pair of connecting means of said support rail includes:

a pair of passages extending between the opposite sides of said support rail and substantially perpendicular to the axes of said openings;

a flexible member extending through each of said passages;

said first means of each of said connecting means including attachment means connected to the upper end of each of said flexible members;

each of said flexible members having means on the opposite sides of said support rail to limit the movement in either direction of said flexible member within said passage;

and said second means of each of said connecting means including means on each of said flexible members for connection to said attachment means of another of said support rails therebeneath to permit the vertical spacing between the support rails to be varied.

9. The apparatus according to claim 8 in which said attachment means connected to the upper end of each of said flexible members is a hook.

10. The apparatus according to claim 1 in which each of said second means of each of said connecting means of said support rail includes a plurality of means for selective connection to said first means of the connecting means on another support rail disposed therebeneath to vary the vertical spacing between said support rail and the support rail disposed therebeneath.

* * * * *

UNITED STATES PATENT OFFICE

CERTIFICATE OF CORRECTION

Patent No. 4,067,454 Dated January 10, 1978

Inventor(s) Francis A. Helbling

It is certified that error appears in the above-identified patent and that said Letters Patent are hereby corrected as shown below:

IN THE SPECIFICATION

Column 2, line 14, "bar" should read -- barn --.

Column 3, line 24, "17" should read -- 12 --.

IN THE CLAIMS

Column 8, line 48, "and" should read -- said --.

Column 9, line 3, "based" should read -- base --.

Column 10, line 5, after "combination" insert -- according --.

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*